US008011298B2

(12) United States Patent
Iwamoto et al.

(10) Patent No.: US 8,011,298 B2
(45) Date of Patent: Sep. 6, 2011

(54) SYSTEM FOR SUPPLYING INK AND INK CONTAINER

(75) Inventors: Manabu Iwamoto, Ami-machi (JP); Kenji Oshima, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 1318 days.

(21) Appl. No.: 10/543,051

(22) PCT Filed: Dec. 15, 2003

(86) PCT No.: PCT/JP03/16042

§ 371 (c)(1),
(2), (4) Date: Jul. 21, 2005

(87) PCT Pub. No.: WO2004/065126

PCT Pub. Date: Aug. 5, 2004

(65) Prior Publication Data

US 2006/0139417 A1 Jun. 29, 2006

(30) Foreign Application Priority Data

Jan. 24, 2003 (JP) ..... 2003-016165

(51) Int. Cl.
*B41F 31/02* (2006.01)

(52) U.S. Cl. ..... 101/364; 101/119; 101/483

(58) Field of Classification Search ..... None
See application file for complete search history.

(56) References Cited

U.S. PATENT DOCUMENTS

| | | | | |
|---|---|---|---|---|
| 3,848,529 | A * | 11/1974 | Gegenheimer et al. | 101/363 |
| 4,479,433 | A * | 10/1984 | MacPhee et al. | 101/364 |
| 4,639,776 | A * | 1/1987 | Foerster et al. | 348/61 |
| 5,460,091 | A * | 10/1995 | Mazzenga et al. | 101/366 |
| 5,699,731 | A | 12/1997 | Hara | |
| 6,772,690 | B2 * | 8/2004 | Inoue | 101/484 |

FOREIGN PATENT DOCUMENTS

| | | |
|---|---|---|
| JP | 9039363 | 2/1997 |
| JP | 2002321434 | 11/2002 |

* cited by examiner

*Primary Examiner* — Jill E Culler
(74) *Attorney, Agent, or Firm* — Brian M. McGuire; Matthew K. Ryan; Frommer Lawrence & Haug LLP

(57) ABSTRACT

In an ink supply method and system and an ink container where the ink is automatically supplied in the stencil printing, to permit suitable detection of empty of the ink container even if the kind of ink which has not been set is employed. A parameter representing an inkless time corresponding to the kind of ink (viscosity of ink) is stored in the storage means (8) provided on the ink container (10), the parameter is read out from the storage means (8) and the inkless time is set on the basis of the parameter, whereby it is recognized that the ink container is exhausted when the time for which the ink in the ink fountain (2) is not detected by an ink amount detecting means (40) becomes longer than the inkless time.

8 Claims, 4 Drawing Sheets

FIG.4

| CEASING TIME(CT) | PARAMETERS | | | |
|---|---|---|---|---|
| | A | B | C | D |
| 0 HOURS ≦ CT < 1 HOUR | 20 SECONDS | 20 SECONDS | 30 SECONDS | 30 SECONDS |
| 1 HOUR ≦ CT < 3 HOURS | 20 SECONDS | 30 SECONDS | 30 SECONDS | 30 SECONDS |
| 3 HOURS ≦ CT < 8 HOURS | 30 SECONDS | 30 SECONDS | 35 SECONDS | 40 SECONDS |
| 8 HOURS ≦ CT < 12 HOURS | 30 SECONDS | 30 SECONDS | 35 SECONDS | 40 SECONDS |
| 12 HOURS ≦ CT < 24 HOURS | 30 SECONDS | 30 SECONDS | 35 SECONDS | 40 SECONDS |
| 24 HOURS ≦ CT | 30 SECONDS | 40 SECONDS | 40 SECONDS | 45 SECONDS |

FIG.5

| | PARAMETERS | | | |
|---|---|---|---|---|
| | A | B | C | D |
| NO INK | 40 SECONDS | 40 SECONDS | 60 SECONDS | 70 SECONDS |

SYSTEM FOR SUPPLYING INK AND INK CONTAINER

FIELD OF THE INVENTION

This invention relates to an ink supply method and system, and an ink container for automatically supplying ink in a stencil printer.

BACKGROUND OF THE INVENTION

There have been variously proposed stencil printers where print is made by driving, for instance, a thermal head according to image data obtained by reading out an original by, for instance, a scanner to selectively melt and perforate stencil material to make a stencil, winding the stencil around a printing drum, supplying ink inside the printing drum, and transferring the ink to printing papers through the stencil by, for instance, a roller.

In the stencil printers described above, it is necessary to always hold fixed the amount of ink temporarily stored in the printing drum during printing. As such a method, there has been known a method where, for instance, the amount of ink temporarily stored in the printing drum is detected by an ink sensor and an ink supply pump is controlled according to the detecting signal of the ink sensor.

Specifically, the amount of ink stored in the printing drum can be always held fixed by temporarily storing the ink in a wedge-shaped space (ink fountain) between a cylindrical squeegee roller for applying ink on the inner peripheral surface of the printing drum and a doctor roller which is disposed in parallel to the squeegee roller at a space therefrom for passing the ink so that the ink stored in the ink fountain is supplied to the inner peripheral surface of the printing drum by way of the squeegee roller, and supplying the ink to the ink fountain from an ink container when the amount of ink in the ink fountain is reduced below a predetermined level.

When the amount of ink in the ink fountain does not reach the predetermined level if the ink supply pump is operated for a predetermined time (inkless time) after the ink sensor detects that the amount of ink in the ink fountain is reduced below a predetermined level, it is recognized that the ink container is exhausted and the system is stopped as well as the alarm representing the fact is made. Then the ink container is changed for a new one, whereby print can be further made.

In the stencil printers described above, when a plurality of kinds of ink different from each other in viscosity thereof according to the kind are available and ink lower in its viscosity than standard ink which has been employed in setting the inkless time is employed, that the predetermined amount of ink is supplied is not detected by the ink sensor and the inkless time can expire even if the predetermined amount of ink is supplied since the swirl of the ink generated in the ink fountain is low. In this case, there is a fear that the ink container which yet holds ink therein can be detected as an empty ink container by mistake. Accordingly, it is necessary to elongate the inkless time when the above-mentioned ink is used. Whereas, when ink higher in its viscosity than standard ink which has been employed in setting the inkless time is employed, the time required to be detected by the ink sensor becomes shorter than the standard ink since the swirl of the ink generated in the ink fountain is higher. If the inkless time is elongated when such ink is used, a wasteful long time is required until the operator knows that the ink container is exhausted.

When a ceasing time from interruption of printing and resumption of the same is elongated, the water content and/or solvent of the ink in the ink fountain evaporates to reduce the amount of ink and accordingly, it is necessary to elongate the inkless time by the reduction of the amount of ink when printing is resumed.

Accordingly, it has been proposed to set the inkless time according to the kind of ink or to set the inkless time according to the ceasing time in the stencil printer. (Japanese Unexamined Patent Publication No. 9(1997)-39363)

However, when the inkless time is set in advance in the stencil printer according to the kind of ink, a suitable inkless time cannot be set if the kind of ink which has not been set in the stencil printer is employed, which gives rise to the above-mentioned problem of mistake in detection or the like.

In view of the foregoing observations and description, the primary object of the present invention is to provide a method, a system and an ink container which, in those where the ink is automatically supplied in the stencil printing, permit suitable setting of the inkless time even if the kind of ink which has not been set is employed.

SUMMARY OF THE INVENTION

In accordance with the present invention, there is provided a first ink supply method comprising, in a method where supply of ink from an ink container to an ink fountain where the ink is temporarily stored between the ink is discharged from an ink container and the ink is supplied to the inner peripheral surface of a printing drum is started when the amount of ink in the ink fountain becomes smaller than a first threshold value and is terminated when the amount of ink in the ink fountain becomes not smaller than a second threshold value after the supply of ink is started, the elapsing time from the start of the supply of ink is measured and it is recognized that the ink container is exhausted when the measured elapsing time from the start of the supply of ink becomes longer than a predetermined inkless time before the amount of ink in the ink fountain becomes not smaller than the second threshold value after the supply of ink is started, the steps of reading out a parameter from a storage means which is provided on the ink container to store a parameter representing an inkless time corresponding to the kind of the ink in the ink container, and setting the inkless time on the basis of the parameter.

The "parameter" may be any so long as it is information necessary for setting the inkless time. For example, it may be an inkless time itself or a correction value for an inkless time which has been set in advance. Otherwise, the "parameter" may be a coefficient for calculating the inkless time or a letter or a symbol representing an inkless time.

In accordance with the present invention, there is further provided a second ink supply method comprising, in a method where supply of ink from an ink container to an ink fountain where the ink is temporarily stored between the ink is discharged from an ink container and the ink is supplied to the inner peripheral surface of a printing drum is started when the amount of ink in the ink fountain becomes smaller than a first threshold value and is terminated when the amount of ink in the ink fountain becomes not smaller than a second threshold value after the supply of ink is started, the elapsing time from the start of the supply of ink is measured and it is recognized that the ink container is exhausted when the measured elapsing time from the start of the supply of ink becomes longer than a predetermined inkless time before the amount of ink in the ink fountain becomes not smaller than the second threshold value after the supply of ink is started, the steps of measuring the ceasing time from interruption of printing to resumption of the same, reading out a parameter corresponding to the measured ceasing time from a storage means which is provided on the ink container to store a parameter representing an inkless time corresponding to the kind of the ink in the ink container and the ceasing time, and setting the inkless time on the basis of the parameter.

In accordance with the present invention, there is further provided a first ink supply system comprising an ink supply means which supplies ink in an ink container to an ink fountain where the ink is temporarily stored between the ink is discharged from an ink container and the ink is supplied to the inner peripheral surface of a printing drum, an ink amount detecting means which outputs an ink supply starting signal when the amount of ink in the ink fountain supplied by the ink supply means becomes smaller than a predetermined first threshold value and an ink supply terminating signal when the amount of ink in the ink fountain becomes not smaller than a predetermined second threshold value, a time measuring means which measures the elapsing time from the time the ink supply starting signal is output from the ink amount detecting means, an empty ink container recognizing means which recognizes that the ink container is exhausted when the elapsing time measured by the time measuring means becomes longer than a predetermined inkless time before the ink supply terminating signal is output, and an ink supply control means which starts the ink supply means supplying the ink in response to the ink supply starting signal and stops the ink supply means from supplying the ink in response to the ink supply terminating signal, wherein the improvement comprises that the empty ink container recognizing means reads out a parameter from a storage means which is provided on the ink container to store a parameter representing an inkless time corresponding to the kind of the ink in the ink container, and sets the inkless time on the basis of the parameter.

In accordance with the present invention, there is further provided a second ink supply system which is obtained by converting the first ink supply system so that it has a ceasing time measuring means which measures a ceasing time from interruption of the action of the printing drum and resumption of the same, the parameter stored in the storage means represents an inkless time corresponding to the ceasing time and the kind of the ink in the ink container, and the empty ink container recognizing means sets the inkless time on the basis of the parameter.

In accordance with the present invention, there is further provided a first ink container which is used for carrying out the first ink supply method and comprises a storage means which stores a parameter representing an inkless time corresponding to the kind of the ink therein.

In accordance with the present invention, there is further provided a second ink container which is used for carrying out the second ink supply method and comprises a storage means which stores a parameter representing an inkless time corresponding to the ceasing time and the kind of the ink in the ink container.

In accordance with the first ink supply method and system and the first ink container of the present invention, since a parameter is read out from a storage means which stores a parameter representing an inkless time corresponding to the kind of the ink in the ink container, and the inkless time is set on the basis of the parameter, a suitable inkless time can be set even if the kind of ink which has not been set in the stencil printer is employed and mistake in detection of an empty ink container or the like can be avoided.

In accordance with the second ink supply method and system and the second ink container of the present invention, since the ceasing time from interruption of printing to resumption of the same is measured and a parameter corresponding to the measured ceasing time is read out from a storage means which is provided on the ink container to store a parameter representing an inkless time corresponding to the kind of the ink in the ink container and the ceasing time, and the inkless time is set on the basis of the parameter, a suitable inkless time can be set according to the kind of ink and at the same time, according to the change of the amount of ink in the ink fountain due to elapse of the ceasing time.

BRIEF DESCRIPTION OF THE DRAWINGS

FIG. 4 is a correction table to be used when setting the inkless time on the basis of the kind of ink and the ceasing time, and FIG. 5 is a correction table to be used when setting the inkless time on the basis of the kind of ink and the ceasing time immediately after change of ink containers.

PREFERRED EMBODIMENTS OF THE INVENTION

Figure 1:
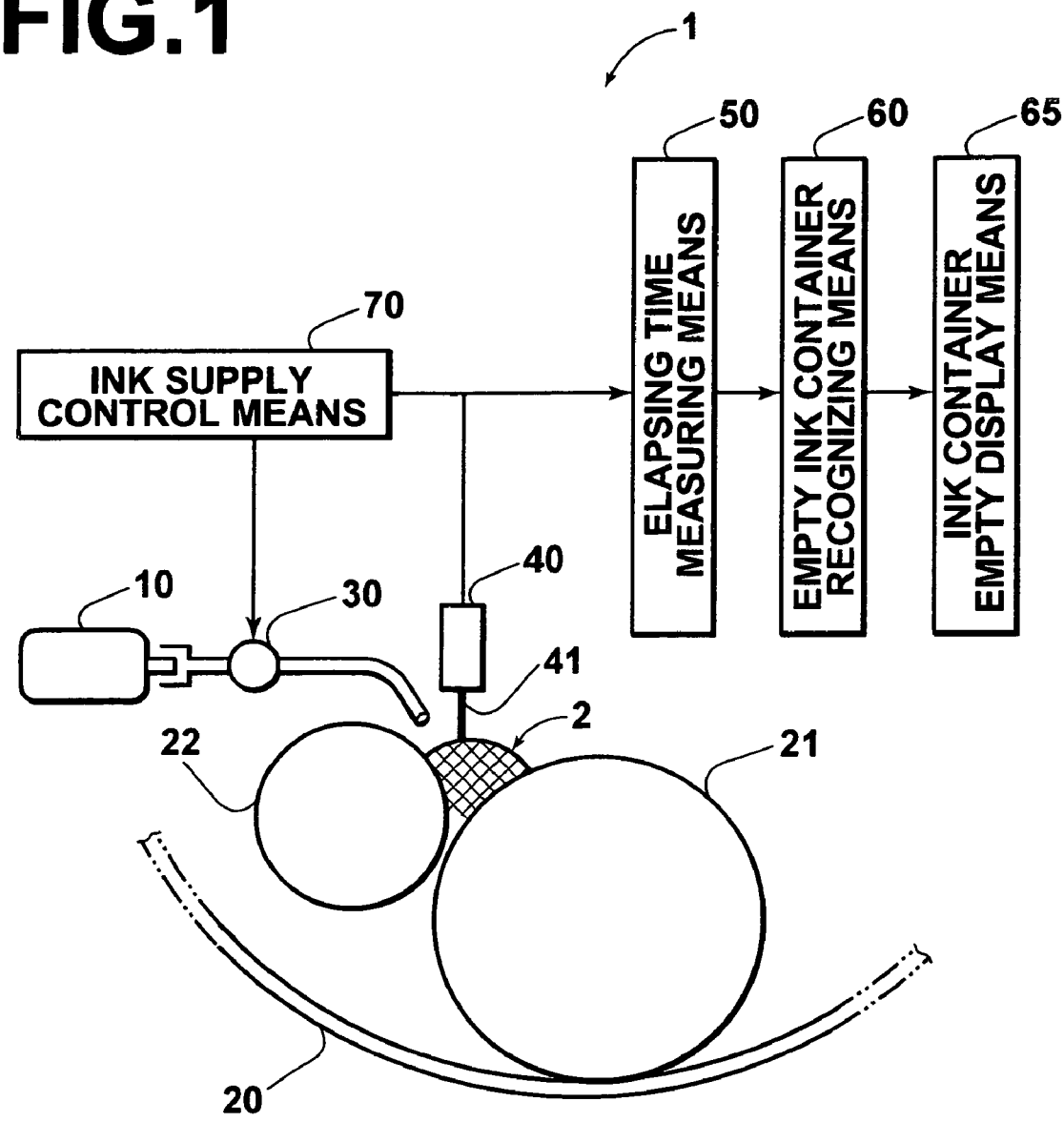
FIG. 1 is a view showing in brief a part of a stencil printer employing an ink supply system in accordance with an embodiment of the present invention.

An ink supply system and an ink container for carrying out an ink supply method in accordance with an embodiment of the present invention will be described, hereinbelow, with reference to the drawings. FIG. 1 is a block diagram showing a part of the stencil printer in which an ink supply system in accordance with an embodiment of the present invention is used.

The ink supply system 1 comprises an ink supply means 30 which supplies ink discharged from an ink container 10 inside a printing drum 20, an ink amount detecting means 40 which outputs an ink supply starting signal when the amount of ink in an ink fountain where the ink is temporarily stored in the course of supply of ink to the printing drum 20 by the ink supply means becomes smaller than a predetermined first threshold value and an ink supply terminating signal when the amount of ink in the ink fountain becomes not smaller than a predetermined second threshold value by the supply of ink, a time measuring means 50 which measures the elapsing time from the time the ink supply starting signal is output from the ink amount detecting means 40, an empty ink container recognizing means 60 which recognizes that the ink container 10 is exhausted when the elapsing time measured by the time measuring means becomes longer than a predetermined inkless time before the ink supply terminating signal is output, and an ink supply control means 70 which starts the ink supply means 30 supplying the ink in response to the ink supply starting signal and stops the ink supply means 30 from supplying the ink in response to the ink supply terminating signal.

The ink container 10 is provided at its leading end with an opening 12 through which the ink is discharged. The opening 12 is connected to an ink supply means 30 disposed inside the printing drum 20 and the ink in the ink container 10 is sucked by the ink supply means 30 to be discharged from the ink container 10 and to be supplied inside the printing drum 20 to be used for printing. As the printing progresses, the ink in the ink container 10 is supplied and consumed, and when the ink in the ink container 10 is exhausted, the ink container 10 is demounted and a new ink container 10 is mounted.

A storage means 8 which stores a parameter representing an inkless time corresponding to the kind of the ink in the ink container 10. The storage means 8 comprises a memory IC 81 forming a non-volatile memory (e.g., an EEPROM) which can hold data for a predetermined time without power supply, and a contact 83 is provided on the tip of a board 82 on which the memory IC 81 is mounted.

A connector 9 which is to be electrically connected to the contact 83 of the storage means 8 of the ink container 10 is provided near the ink supply means 30 of the ink supply system 1. And the connector 9 and the empty ink container recognizing means 60 are connected to each other so that the parameter representing the inkless time stored in the storage means 8 is read out by the empty ink container recognizing means 60.

A cylindrical squeegee roller 21 for applying ink on the inner peripheral surface of the printing drum (20) and a doctor roller 22 which is disposed in parallel to the squeegee roller 21 at a space therefrom for passing the ink are provided inside the printing drum 20 so that their central axes are in parallel to the central axis of the printing drum 20. The space which is wedge-shaped in cross-section between the squeegee roller 21 and the doctor roller 22 forms an ink fountain 2.

Operation of the ink supply system 1 will be described, hereinbelow.

While the printing drum 20 is operated and print is being made, the ink in the ink fountain is applied to the printing drum 20 by way of the squeegee roller 21 to be consumed, and the ink is repeatedly supplied to the ink fountain 2 by the amount corresponding to the consumed amount of the ink.

Specifically, when the ink in the ink fountain 2 shown in FIG. 1 is consumed and the tip of a detecting probe 41 of the ink amount detecting means 40 which has been inserted into the ink fountain 2 goes away from the ink in the ink fountain 2, whereby that the amount of ink in the ink fountain 2 becomes smaller than a first threshold value is detected, the ink supply starting signal is output from the ink amount detecting means 40. The ink supply starting signal is input into the time measuring means 50 and the ink supply control means 70. In this particular embodiment, the ink amount detecting means 40 recognizes that the amount of ink in the ink fountain 2 becomes smaller than a first threshold value when the detecting probe 41 of the ink amount detecting means 40 comes not to detect the ink in the ink fountain 2.

The ink supply control means 70 operates the ink supply means 30 in response to the ink supply starting signal, whereby the ink in the ink container 10 is supplied to the ink fountain 2 by the ink supply means 30. When the amount of ink in the ink fountain 2 is increased by the supply of ink by the ink supply means 30 and the leading end of the detecting probe 41 comes to contact with the ink, whereby that the amount of ink in the ink fountain 2 reaches a second threshold value is detected, the ink amount detecting means 40 outputs the ink supply terminating signal and the ink supply control means 70 stops the ink supply means 30 in response to the ink supply terminating signal, whereby supply of the ink into the ink container 10 is stopped.

The time measuring means 50 measures the elapsing time from the time the ink supply starting signal is input and outputs the elapsing time to the empty ink container recognizing means 60 in real time. The empty ink container recognizing means 60 recognizes that the ink container 10 is exhausted when the elapsing time input from the time measuring means 50 becomes longer than a predetermined inkless time before the amount of ink in the ink fountain 2 reaches the second threshold value and outputs the signal representing the fact. The inkless time which has been set in advance in the empty ink container recognizing means 60 is set in the following manner.

Figure 2:
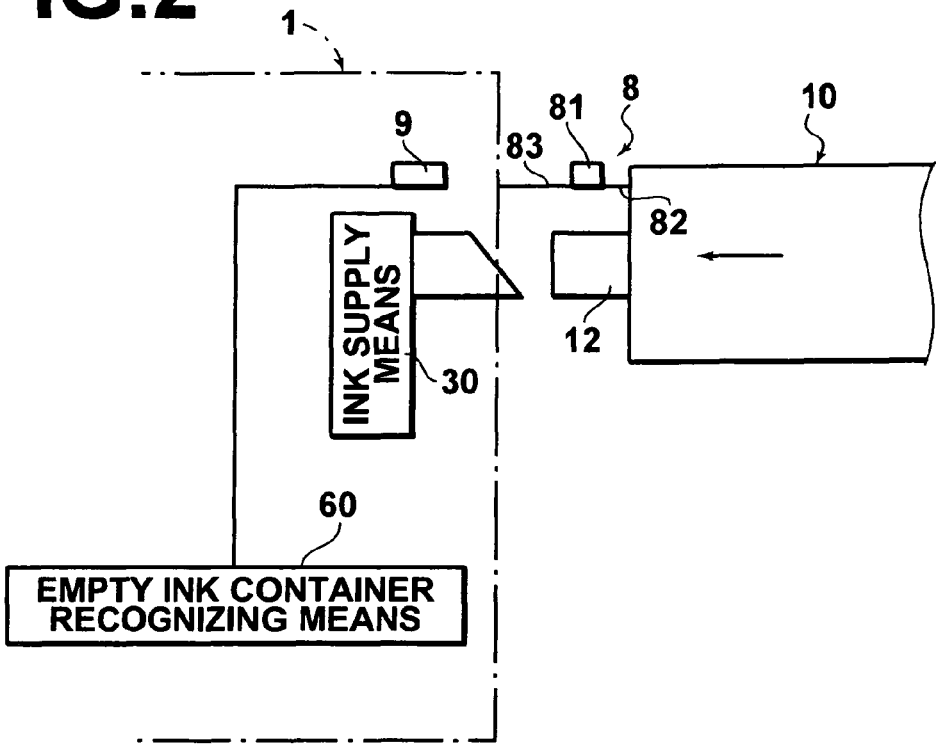
FIG. 2 is a view showing in detail the ink container employed in the ink supply system shown in FIG. 1.

That is, when the ink container 10 is connected to the ink supply means 30 shown in FIG. 2, the connector 9 provided in the vicinity of the ink supply means 30 and the contact 83 of the storage means 8 provided on the ink container 10 are electrically connected to each other, whereby the parameter representing the inkless time stored in the storage means 8 is read out by the empty ink container recognizing means 60 and the inkless time is set on the basis of the parameter.

In the empty ink container recognizing means 60, a standard inkless time which has been empirically obtained in advance by a standard ink has been stored. However, if the standard inkless time is always used, for instance, when the viscosity of the ink in the ink container 10 is lower than that of the standard ink, the time required to be detected by the ink amount detecting means 40 becomes longer than the standard ink since the swirl of the ink generated in the ink fountain 2 is low. When the standard inkless time is used even in this case, there is a fear that the empty ink container recognizing means 60 can recognize that the ink container 10 which yet holds ink therein as an empty ink container by mistake. Accordingly, it is necessary to elongate the inkless time when the viscosity of the ink in the ink container 10 is lower than that of the standard ink. Whereas, when the viscosity of the ink in the ink container 10 is higher than that of the standard ink, the time required to be detected by the ink sensor becomes shorter than the standard ink since the swirl of the ink generated in the ink fountain is higher. Accordingly, it is necessary to shorten the inkless time in this case.

Accordingly, the above-mentioned parameters different from each other according to the kind of the ink in the ink container 10 are stored in the storage means 8 of the ink container 10, and the empty ink container recognizing means 60 reads out the parameter in the storage means 8 and sets the inkless time on the basis of the parameter read out. Specifically, a correction value corresponding to the kind of the ink is stored in the storage means 8 and a suitable inkless time is set by adding the correction value to the standard inkless time. For example, when the viscosity of the ink in the ink container 10 is lower than that of the standard ink, a positive correction value is employed to make longer the inkless time than that for the standard ink. Whereas, when the viscosity of the ink in the ink container 10 is higher than that of the standard ink, a negative correction value is employed to make shorter the inkless time than that for the standard ink.

When the inkless time set in the manner described above has elapsed and the empty ink container recognizing means 60 outputs a signal representing that the ink container has been exhausted, the stencil printer is interrupted and a lamp of an ink container empty display means 65 is lit. The elapsing time is reset each time the ink amount detecting means 40 outputs the ink supply terminating signal.

In the ink supply system and the ink container of the embodiment described above, a parameter is read out from the storage means 8 which stores a parameter representing an inkless time corresponding to the kind of the ink in the ink container 10 and the inkless time is set on the basis of the parameter. Accordingly, a suitable inkless time can be set even if the kind of ink which has not been set in the stencil printer is employed and mistake in detection of an empty ink container or the like can be avoided.

The inkless time set in the embodiment described above is set on the assumption that the ink container 10 has been exhausted in the case where the amount of ink in the ink fountain 2 is reduced smaller than the first threshold value with consumption of the ink during printing and the ink supply means 30 is operated to increase the amount of ink in the ink fountain 2 not smaller than the second threshold value. That is, the inkless time is the time which is required to increase the amount of ink in the ink fountain 2, which has been reduced smaller than the first threshold value, not smaller than the second threshold value. For example, when an ink container 10 is exhausted to be replaced with a new one, an empty ink container 10 can be installed by mistake. When the same inkless time is employed in such a case to recognize that the ink container 10 is exhausted, there is a fear that the ink container which yet holds ink therein can be recognized as an empty ink container by mistake, since bad ink continuity (due to mingling of foams in the ink due to, for instance, formation of spaces where no ink exists between the ink in the ink container and the ink in the ink passage in the vicinity of the ink supply means) is generally caused after a new ink container is installed due to change of the ink containers and the inkless time has elapsed. Accordingly, in order to correctly recognize whether the ink container 10 is empty immediately after change of the ink containers, an inkless time longer than that during printing may be set. Immediately after change of the ink containers, by the use of an elongated inkless time whether the installed ink container 10 is empty can be correctly recognized. Further, it is possible to store in the storage means 8 of the ink container 10 the correction value for setting the inkless time immediately after change of the ink containers. In this case, it is preferred that the correction value for setting the inkless time immediately after change of the ink containers be longer than that for setting the inkless time during printing.

Figure 3:
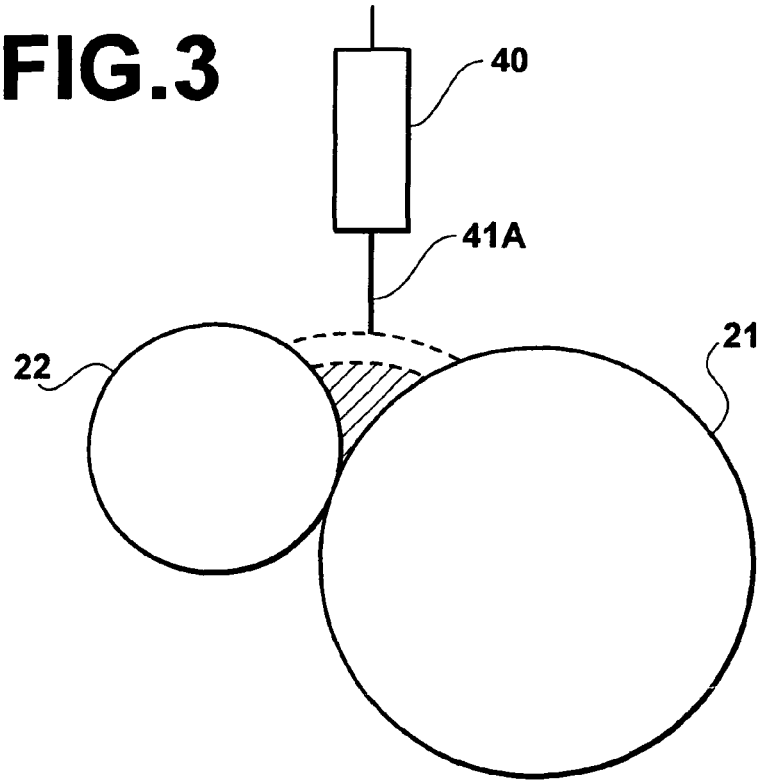
FIG. 3 is a view for illustrating reduction of the amount of ink in the ink fountain after the ceasing time.

When printing is once interrupted and resumed thereafter, the water content and/or solvent of the ink in the ink fountain evaporates to reduce the amount of ink as shown in FIG. 3. The reduction is increased as the ceasing time from interruption of printing and resumption of the same is elongated. Accordingly, also when there is a ceasing time, there is a fear that the ink container (10) which yet holds ink therein can be recognized as an empty ink container (10) by mistake, and it is necessary to set suitably the inkless time. In this case, for instance, the empty ink container recognizing means 60 is provided with a ceasing time measuring means which measures the ceasing time from interruption of printing and resumption of the same and a correction table such as shown in FIG. 4 where the ceasing time is related to parameters A to D so that one of the parameters A to D is stored in the storage means 8 of the ink container 10 and the empty ink container recognizing means 60 obtains and sets the inkless time by referring to the correction table on the basis of the ceasing time measured by the ceasing time measuring means and the parameter read out from the storage means 8 of the ink container 10. In the storage means 8 of the ink container 10, a suitable parameter which has been empirically determined in advance is stored.

When the inkless time immediately after change of the ink containers is to be set in the case where the inkless time corresponds to both the ceasing time and the kind of ink, it is possible to prepare a correction table such as shown in FIG. 5 separately from the correction table shown in FIG. 4 so that the inkless time to be set is elongated. When two correction tables are prepared as described above, the storage means 8 may store different parameters for reference to the correction table shown in FIG. 4 and for reference to the correction table shown in FIG. 5. For example, the storage means 8 may store the parameter A as the parameter for reference to the correction table shown in FIG. 4 and the parameter B as the parameter for reference to the correction table shown in FIG. 5.

Though, in the embodiment described above, a parameter representing the inkless time corresponding to the kind of ink is stored in the memory IC 81 of the storage means 8, the inkless time may be recorded as a bar code. Otherwise, the inkless time may be recorded as a letter or a symbol.

The correction table such as shown in FIG. 4 or 5 may be stored in the memory IC 81 of the storage means 8 so that the empty ink container recognizing means 60 sets the inkless time referring to the correction table.

The invention claimed is:

1. An ink supply system, comprising:

an ink supply means which supplies ink in an ink container to an ink fountain where the ink is temporarily stored between a first point in time when the ink is discharged from the ink container and a second point in time when the ink is supplied to an inner peripheral surface of a printing drum;

an ink amount detecting means which outputs an ink supply starting signal when the amount of ink in the ink fountain supplied by the ink supply means becomes smaller than a predetermined first threshold value and an ink supply terminating signal when the amount of ink in the ink fountain becomes not smaller than a predetermined second threshold value;

a time measuring means which measures an elapsed time from the time the ink supply starting signal is output from the ink amount detecting means;

an empty ink container recognizing means which recognizes that the ink container is exhausted when the elapsed time measured by the time measuring means becomes longer than a predetermined inkless time before the ink supply terminating signal is output; and an ink supply control means which starts the ink supply means supplying the ink in response to the ink supply starting signal and stops the ink supply means from supplying the ink in response to the ink supply terminating signal, wherein the improvement comprises that the empty ink container recognizing means reads out numeric information from a storage means which is provided on the ink container to store numeric information for setting an inkless time corresponding to the kind of ink in the ink container, and sets the inkless time on the basis of the numeric information.

2. An ink supply system as defined in claim 1 in which the kind of ink represents the viscosity of the ink.

3. An ink supply system, comprising:

an ink supply means which supplies ink in an ink container to an ink fountain where the ink is temporarily stored between a first point in time when the ink is discharged from an ink container and a second point in time when the ink is supplied to an inner peripheral surface of a printing drum, an ink amount detecting means which outputs an ink supply starting signal when the amount of ink in the ink fountain supplied by the ink supply means becomes smaller than a predetermined first threshold value and an ink supply terminating signal when the amount of ink in the ink fountain becomes not smaller than a predetermined second threshold value, a time measuring means which measures the elapsed time from the time the ink supply starting signal is output from the ink amount detecting means, an empty ink container recognizing means which recognizes that the ink container is exhausted when the elapsed time measured by the time measuring means becomes longer than a predetermined inkless time before the ink supply terminating signal is output, and an ink supply control means which starts the ink supply means supplying the ink in response to the ink supply starting signal and stops the ink supply means from supplying the ink in response to the ink supply terminating signal, wherein the improvement comprises that the empty ink container recognizing means reads out a parameter from a storage means which is provided on the ink container to store a parameter representing an inkless time corresponding to the kind of ink in the ink container, and sets the inkless time on the basis of the parameter, and wherein the ink supply system further comprises a ceasing time measuring means which measures a ceasing time from interruption of the action of the printing drum and resumption of the same, wherein the parameter stored in the storage means represents an inkless time corresponding to the ceasing time and the kind of ink in the ink container, and the empty ink container recognizing means sets the inkless time on the basis of the parameter.

4. An ink supply system as defined in claim 3 in which the kind of ink represents the viscosity of the ink.

5. An ink container in combination with an information storage device which is used for carrying out an ink supply method where supply of ink from an ink container to an ink fountain where the ink is temporarily stored between a first point in time when the ink is discharged from an ink container and a second point in time when the ink is supplied to the inner peripheral surface of a printing drum is started when the amount of ink in the ink fountain becomes smaller than a first threshold value and is terminated when the amount of ink in the ink fountain becomes not smaller than a second threshold value after the supply of ink is started, the elapsed time from the start of the supply of ink is measured, it is recognized that the ink container is exhausted when the measured elapsed time from the start of the supply of ink becomes longer than a predetermined inkless time before the amount of ink in the ink fountain becomes not smaller than the second threshold value after the supply of ink is started, a numeric information is read out from the information storage device to store a numeric information for setting an inkless time corresponding to the kind of ink in the ink container, and the inkless time is set on the basis of the numeric information, wherein the information storage device is provided on the ink container and stores the numeric information for setting an inkless time corresponding to the kind of ink therein.

6. An ink container as defined in claim 5 in which the kind of ink represents the viscosity of the ink.

7. An ink container in combination with an information storage device which is used for carrying out an ink supply method where supply of ink from an ink container to an ink fountain where the ink is temporarily stored between a first point in time when the ink is discharged from an ink container and a second point in time when the ink is supplied to the inner peripheral surface of a printing drum is started when the amount of ink in the ink fountain becomes smaller than a first threshold value and is terminated when the amount of ink in the ink fountain becomes not smaller than a second threshold value after the supply of ink is started, the elapsed time from the start of the supply of ink is measured, it is recognized that the ink container is exhausted when the measured elapsed time from the start of the supply of ink becomes longer than a predetermined inkless time before the amount of ink in the ink fountain becomes not smaller than the second threshold value after the supply of ink is started, a ceasing time from interruption of printing to resumption of the printing is measured, a parameter corresponding to the measured ceasing time is read out from the information storage device to store a parameter representing an inkless time corresponding to the kind of ink in the ink container and the ceasing time, and the inkless time is set on the basis of the parameter, wherein the information storage device is provided on the ink container and stores a parameter representing an inkless time corresponding to the ceasing time and the kind of ink in the ink container.

8. An ink container as defined in claim 7 in which the kind of ink represents the viscosity of the ink.

* * * * *